US006980762B2

(12) United States Patent
Bogoshian

(10) Patent No.: US 6,980,762 B2
(45) Date of Patent: Dec. 27, 2005

(54) MODULAR MULTI-STAGE FUSING SYSTEM

(75) Inventor: Gregory V. Bogoshian, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 145 days.

(21) Appl. No.: 10/739,137

(22) Filed: Dec. 19, 2003

(65) Prior Publication Data

US 2005/0135847 A1 Jun. 23, 2005

(51) Int. Cl.[7] ..... G03G 15/20
(52) U.S. Cl. ..... 399/328; 399/341
(58) Field of Search ..... 399/328, 341

(56) References Cited

U.S. PATENT DOCUMENTS 6,647,239 B2 * 11/2003 Oberhoffner ..... 399/361

FOREIGN PATENT DOCUMENTS

| | | | | |
|---|---|---|---|---|
| JP | 63192068 A | * | 8/1988 | ..... G03G 15/20 |
| JP | 09171320 A | * | 6/1997 | ..... G03G 15/20 |
| JP | 09258597 A | * | 10/1997 | ..... G03G 15/20 |
| JP | 09265243 A | * | 10/1997 | ..... G03G 15/20 |
| JP | 11038819 A | * | 2/1999 | ..... G03G 15/20 |
| JP | 2002123108 A | * | 4/2002 | ..... G03G 15/20 |

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

A multi-stage fusing system for fixing toner images to copy substrates of various weights has a primary fuser and a secondary fuser in series with the primary fuser. Various weights of print substrates may have toner images fixed thereon by the primary fuser. The various print substrates are then transmitted to the secondary fuser or directly to a finishing area. The secondary fuser is designed specifically for heavier weight substrates and a bypass paper path is provided for allowing lighter weight substrates to bypass the secondary fuser.

20 Claims, 4 Drawing Sheets

MODULAR MULTI-STAGE FUSING SYSTEM

BACKGROUND OF THE INVENTION

1. Field of Invention

This invention relates generally to an electrophotographic copying apparatus, and more particularly, to the heat and pressure fixing of toner images formed on a copy substrate by direct contact with a heated fusing member.

2. Description of Related Art

In the process of xerography, a light image of an original to be copied is typically recorded in the form of a latent electrostatic image upon a photosensitive member with subsequent development of the latent image by the application of marking particles commonly referred to as toner. The visual toner image is typically transferred from the member to a copy substrate, such as a sheet of plain paper, with subsequent affixing of the image by one of several fusing techniques.

In one type of fusing system, a fuser roll is used which has an outer surface or covering of polytetrafluoroethylene or silicone rubber, the former being known by the trade name "Teflon", to which a release agent such as silicone oil is applied. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

Another type of fusing system includes a primary fuser for fixing toner images formed on either side of a support material. The support material is run through the primary fuser for fixing of toner on a first side and then run through the primary fuser a second time for fixing of toner on a second side of the support material.

Known fusing devices handle many types of print mediums, such as, for example, paper, card stock, poster board, or the like. Heavier weight and many coated copy mediums require more energy to be fused. Lighter weight copy mediums require less energy for fusing. Too much energy applied to a light weight copy medium, such as, for example, paper, results in over-fusing of the paper and non-uniform cooling. Over-fusing of the paper and/or non-uniform cooling results in paper deformation, paper wrinkle, and other print defects. The deformations in the paper will set once the paper cools. Further, too much energy may also result in difficulties in stripping the paper off the roll because the paper will become "flimsy" when overheated.

Application of more energy than required for a given print medium will also tend to negatively affect the quality of the toner. More specifically, the toner may split (leaving some toner on the fuser roll and some on the image on the medium) and/or offsetting may occur (re-depositing some or all of the toner to the next print). This may further lead to contamination of the fusing system.

Not enough energy applied to a heavier weight copy medium, such as, for example card stock, will result in the toner image not being fully fused, causing print defects. Simply setting the fuser roll 16 and pressure roll 18 at a lower temperature to accommodate light copy mediums, and then, for example, passing heavier weight copy mediums through the primary fuser system 10 more than once will not yield satisfactory results. With multiple pass fusing, by the time the copy medium gets transported back to the pre-fuser transport 12, the paper is already cooled to a point where there would be no added benefit in passing the paper through the fuser again.

The primary fusing device 10 is designed to handle a full range of paper weights. However, heavier stocks, such as, for example 280 gsm uncoated or coated stocks, require a substantial amount of energy to be put into the paper to fuse, for example, four layers of toner (cyan, black, magenta and yellow) at a level that is acceptable to, for example, the graphic arts industry.

Further, the primary fusing device 10 must handle lighter stocks, such as, for example, 50 gsm uncoated and coated stocks, without over fusing these lighter weight stocks. Heavy weight papers, especially smooth coated heavy weights, are proving to be difficult to fuse because so much energy is being put into the paper that gloss differential on the first side image in the paper of the pre-fuser transport occurs due to non-uniform cooling effects of the post fuser vacuum transport and pinch roller transports. Further, increasing fuser nips and raising temperatures with thicker-coated rolls will not allow for medium to low beam strength copy mediums (i.e., light weight to medium weight mediums) to strip with primary fusing device 10.

Fusers must also handle high gloss papers. With high gloss papers, too much energy applied to the paper will result in image artifacts, such as, for example, a false image of the post-fuser transport and pinch roller due to non-uniform cooling. Further, to fuse a heavier weight substrate with merely a single fuser system, visible defects will result. Further still, the light weight substrates will be compromised.

There is a need for a fuser that can adequately fuse a full range of copy medium substrates. A single fuser operating space to achieve the performance goals on all substrates has not been possible. The present invention provides a full system solution wherein a secondary fusing system, in series with the primary fusing device 10, is provided to accommodate a range of print substrates.

SUMMARY OF THE INVENTION

Thus, there is a need for a fusing system for use with a wide variety of different copy weight mediums as used in the graphic arts industry.

There is a need for a fusing system that requires minimal maintenance.

There is a need for a fusing system that will provide longer dwell times for heavier weight substrates.

There is a need for a fusing system that will provide a better quality print for both light weight substrates and heavy weight substrates.

There is also a need for a fusing system that will allow for an increased life of the parts used therein.

The present invention relates to a multi-stage fusing system for fixing toner images to copy substrates of various types, the multi-stage fusing system comprising a first fuser module capable of fixing a toner image to a copy substrate in a simplex or duplex mode, a second fuser module in series with the first fuser module wherein the second fuser module has a first fuser roll and a second fuser roll, and a controller for controlling the transmission of the copy substrates in the multi-stage fusing system. The second fuser roll is in contact with the first fuser roll to form a fusing nip therebetween wherein pressure and heat from the first fuser roll and the second fuser roll are applied to both sides of the copy substrate simultaneously, thus having the ability to adequately fix toned images to both the simplexed and duplexed sides of high beam strength heavyweight stocks simultaneously.

The present invention provides a fuser system comprised of both a primary fusing device and a secondary fusing device in series with the primary fusing device. The secondary fusing device is designed specifically for heavier weight substrates and a bypass paper path is provided for allowing lighter weight substrates to bypass the secondary fusing device. The secondary fusing device preferably uses larger diameter fuser rolls, both of which are heated to fusing temperatures, for adequate fusing of heavier weight substrates which may or may not be imaged on both sides.

In particular, toner is affixed to the substrate in the primary fuser well enough to transport the partially fused sheets (heavy weight) or completely fused sheets (light weight) through the duplex path for duplex imaging and fusing and decurling of the duplex print. The heavier weight substrate is then transported to the secondary fuser and the lighter weight paper bypasses the secondary fuser and is instead directly transported to the finishing area.

In exemplary embodiments, the fuser system allows for fusing a plurality of different weight copy mediums at optimum fusing parameters (temperature, pressure and dwell) for each copy medium.

In exemplary embodiments, the fuser system allows for a lower set temperature to accommodate light weight substrates and provide for longer life of parts.

In exemplary embodiments, the fuser system allows for a higher set speed for light weight substrates as lower dwell times in nip are required for lower weight papers to provide adequate fix.

In exemplary embodiments, the fuser system allows for a higher set temperature to accommodate heavy weight substrates.

In exemplary embodiments, the fuser system allows for a lower set speed for heavy weight substrates by employing multiple secondary fusers at lower speeds gating alternate sheets to alternate secondary fusers.

In exemplary embodiments, the fuser system allows for longer dwell time for heavy weight substrates.

BRIEF DESCRIPTION OF THE DRAWINGS

The invention will be further described with reference to the following drawings, wherein.

DETAILED DESCRIPTION OF PREFERRED EMBODIMENTS

The present invention is a multi-stage fusing system which incorporates a primary fusing device of one configuration which is designed to operate with both simplex and duplex mode fusing to various paper substrates and capable of stripping the substrates, including light weight varieties, to deliver the prints to a separate fusing device downstream of the duplex paper path. The separate fusing device is herein referred to as a secondary fusing device.

Figure 1:
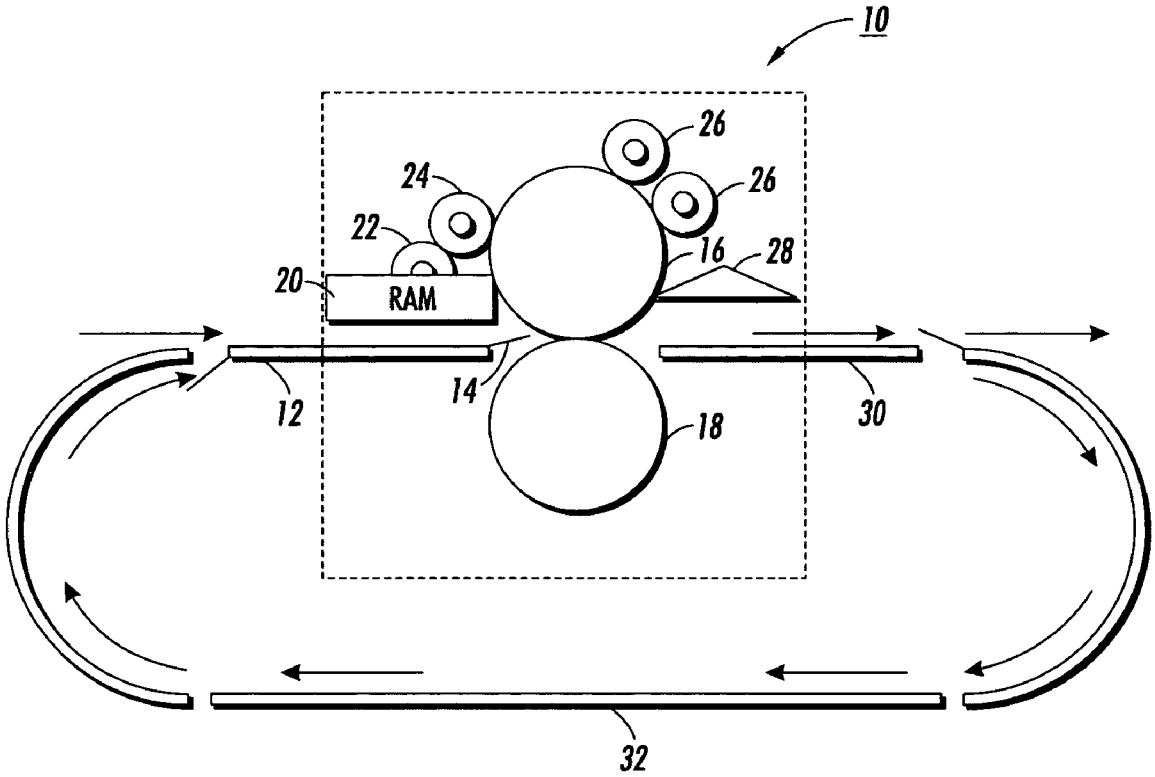
FIG. 1 RELATED ART
FIG. 1 illustrates a known fuser system.

Referring to FIG. 1, a known primary fusing device 10 is illustrated. A copy medium or substrate, such as, for example, a sheet of paper (not shown), is fed to the primary fusing device 10 by a pre-fuser transport 12. More specifically, the pre-fuser transport 12 carries the substrate and a pre-fuser baffle 14 feeds the substrate between a fuser roll 16 and a pressure roll 18.

A release agent management system (RAM) 20 or chemically active fuser agent (not shown) supplies a coating of oil to the fuser roll 16. A metering roll/metering blade system 22 gauges how much oil (not shown) goes into the system. A donor roll 24 applies the oil from the metering roll 22 to the fuser roll 16.

The pressure roll 18 may have a temperature within a range of 200° F. to 220° F., typically about 200° F. The temperature of the fuser roll 16 varies from about 375° F. to about 400° F., depending upon a type of paper being transferred through the fusing device 10. For light weight substrates a lower temperature, such as, for example about 375° F. is set for the fuser roll 16. For higher weight substrates, a higher temperature, such as, for example 400° F. for the fuser roll 16 is appropriate. A pressure roll temperature for one technology must be maintained between 200° F. and 220° F. to prevent post fuser duplex print quality artifacts/defects.

It should be noted that the temperature of the pressure roll 18 and the fuser roll 16 is set at a specific temperature, thus the temperature of the pressure roll 18 and the fuser roll 16 may be set at a temperature that is too high for light weight substrates and/or too low for heavy weight substrates. For example, if the pressure roll 18 is set to a temperature greater than about 225° F., especially in a duplex mode, image problems may result. For example, a pattern of the fuser exit transport may become visible on the substrate, a gloss differential may be visible, and the like.

In one xerographic printing system, for example, the fuser roll 16 is heated from a heating element (not shown) located in the core of the fuser roll 16. In order to maintain a consistent temperature in the fuser roll 16, the fuser roll 16 is also heated by a plurality of external heat rolls 26, which apply energy to a surface of the fuser roll 16.

The substrate is fed between the fuser roll 16 and the pressure roll 18, wherein heat and pressure is applied to the substrate, thereby affixing the toner image to the substrate. Stripper fingers (not shown) on the pressure roll 18 help to properly guide the substrate to a lower guide (not shown) and to a post-fuser transport (not shown).

Stripping may be required with light weight substrates because the light weight substrates do not have a high beam strength and thus tend to attach to the fuser roll 16 or the pressure roll 18. Thus, an air knife (not shown) on the fuser roll 16 and stripper fingers on the pressure roll 18 are used to peel the substrate off of the fuser roll 16 or the pressure roll 18, respectively, if necessary. Without the stripper fingers or without the air knife, the substrate may wrap around the fuser roll 16 or the pressure roll 18.

In one printing system, for example, after the toner image is fused to the substrate, the substrate is removed from the fuser roller 16 with the air knife and transferred to the post-fuser transport 30 via a vacuum exit transport 28. The vacuum exit transport 28 provides a cooling zone for the paper.

For duplex fusing (i.e., images on both sides of the substrate) the substrate is flipped over and returned via a duplex paper path 32 to the pre-fuser transport 12 and the process is repeated for the opposite side of the paper.

The multi-stage fusing system of the present invention incorporates a first fusing device, such as, for example, the primary fusing device 10 described above, to fuse toner images to various copy substrates with enough permanence to deliver the prints to a secondary fusing device. The scope of the present invention is not limited to the primary fusing device 10 described above, but is meant to include any known fusing device. Thus, reference to the primary fusing device 10 hereafter refers to any known fusing device. As will be described in greater detail, a copy substrate will be fused by the primary fusing device 10, will be forwarded to a decurler and then, if necessary, will be forwarded to the secondary fusing device or through the duplex xerographic process without causing printer artifacts or defects as a result of being transported through the duplex paper path before being transported to a finishing station.

Figure 2:
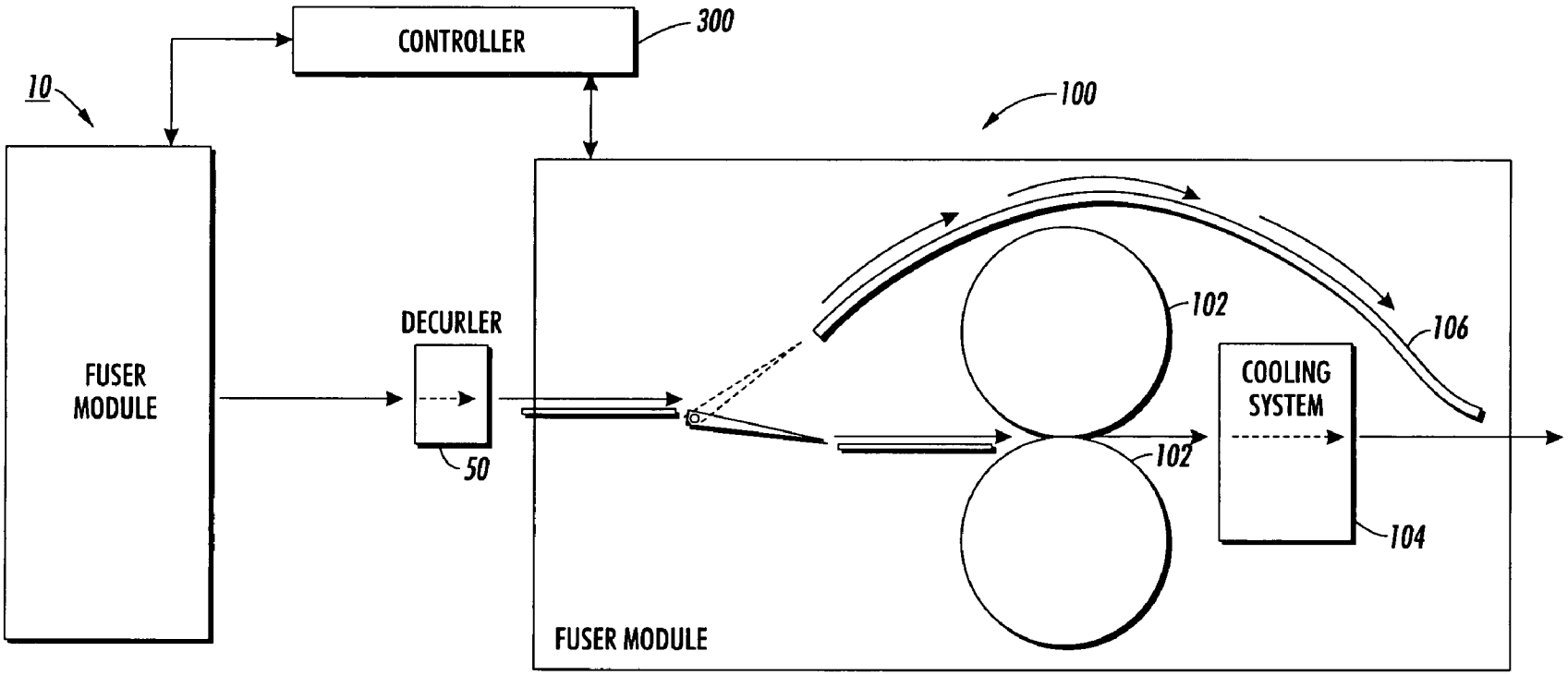
FIG. 2 illustrates a multi-stage fusing system of the present invention.

Referring to FIG. 2, after the toner is fused to a copy substrate, such as, for example, paper, via the primary fusing device 10, the substrate is optionally transported to a decurler 50. Because the nip is curved and is heated in the primary fusing device 10 and because moisture in the copy substrate is driven away from a side of the copy substrate against the fuser roll, curl may be induced into the substrate. The decurler 50 will counter the induced curl. At the duplex mode, the paper is more susceptible to curl. Thus, the paper is transported to the decurler 50 after the duplex mode. If the paper has not gone through the duplex mode, the paper may not need to be decurled and may bypass the decurler 50 to be transported to a finishing area (not shown). The finishing area is well known in the art and may comprise any end finishing, e.g., stapling, binding, etc.

Two separate fuser devices in series, a first or primary fusing device 10 and a secondary fusing device 100 of the multi-stage fusing system, are illustrated in FIG. 2. The secondary fusing device 100 preferably includes at least two fuser rolls 102. Both fuser rolls 102 are heated for simultaneous duplex re-fuse. The secondary fusing device 100 also has a bypass transport 106 for lighter weight substrates which do not require re-fusing by the secondary fusing device 100. An additional cooling/moisturizing station 104 to improve the operating latitude may also be provided.

A controller 300 will determine whether the substrate will be subject to fusing in a simplex or duplex mode, and whether the substrate will be transmitted to the decurler 50 and/or the secondary fusing device 100 and/or the cooling/moisturizing station 104 in addition to being transmitted to the primary fusing device 10. Alternatively, a user may preselect where the substrate will be transmitted.

The pressure roll 18 and fuser roll 16 of the primary fusing device 10 may be set at temperatures of, for example, about 200° F. and 375° F., respectively. These temperatures of the pressure roll 18 and the fuser roll 16 of the primary fusing device 10 would achieve the fusing performance required for substrates on the light weight end of the substrate range, thereby allowing light weight substrate to bypass fusing by the secondary fusing device 100 and proceed to a finishing area (not shown).

The fuser rolls 102 of the secondary fusing device 100 may be set at, for example, a temperature of about 400° F. This higher temperature would achieve the fusing performance required for substrates on the high weight end of the substrate range. Because the secondary fusing device 100 imparts increased amounts of energy into the substrates, a cooling/moisturizing station 104 may also be provided to remove excessive heat and re-moisturize the substrate, if necessary. The controller 300 may set the temperature of the pressure roll 18 and fuser roll 16 of the primary fusing device 10 as well as the temperature of the fuser rolls 102 of the secondary fusing device 100. Alternatively, a user may set the temperature of the pressure roll 18, fuser roll 16 and/or the fuser rolls 102.

Further, the secondary fusing device 100 preferably includes two fuser rolls 102 that have relatively larger diameters than the fuser roll 16 and/or pressure roll 18 used in the primary fusing device 10. The larger diameter fuser rolls 102 allow for a larger nip area and thus a longer dwell time, (i.e., the amount of time spent between the two fuser rolls 102). A longer dwell time would further enhance the fusing performance on the heavy weight substrates. The controller 300 may also set the speed of the primary fusing device 10 and the secondary fusing device 100, thereby controlling the dwell time of each of the primary fusing device 10 and the secondary fusing device 100. Alternatively, a user may set the speed of each of the primary fusing device 10 and the secondary fusing device 100.

Further, the controller 300 may, via latitude testing and/or verification testing, determine what types of substrates may pass though the primary fusing device 10, the secondary fusing device 100 and/or both fusing devices based on a weight, strength, composition and/or other criteria of the substrate.

In other words, the two separate fusing stages together allow for a fusing system that can handle a full range of print substrates. The primary fusing device 10 is designed to be able to adequately fuse the image onto substrates of a first type, e.g., high gloss coated substrate, light weight print substrate and the like, either in a simplex or duplex mode. The light weight substrate will be transferred from the primary fusing device 10 via a bypass path 106 directly to a finisher/stacker area (not shown) after fusing, thus bypassing the secondary fuser. Substrates of a second type, e.g., heavy weight substrates, will be transferred from the primary fusing device 10 to the secondary fusing device 100. The controller 300 may determine the weight of the substrate, or, alternatively, a user may identify the weight of the substrates. Examples of light weight copy substrates may include, but are not limited to, 16 pound bond paper, 20 pound bound paper, 24 pound bound paper, 59 gsm Accent Opaque, 80 pound Text Lustro Gloss, or the like. Examples of heavy weight copy substrates may include, but are not limited to, 110 pound Index Stock, 100 pound Lustro Gloss Cover Stock, 270 gsm Cover Stock, or the like. Further, high beam strength is typically required for passage through the secondary fusing process.

Simply requiring a heavy weight substrate to pass through the primary fusing device a second, or multiple, times will not achieve the benefits of the multi-stage fusing system described herein. Specifically, the heavy weight substrate will begin to cool while being transported to pass through the primary fuser device 10 a second or multiple time and may not be subject to the higher temperatures (i.e., 400° F. fuser rolls 102) or the large nip area and long dwell time provided by the secondary fusing device 100.

The heavy weight stock substrates, which need more energy, will then be transferred into the secondary fusing device 100, where energy to both fuser rollers 102 allows for fusing in both simplex and duplex modes simultaneously. More specifically, the substrate passes between the two fuser rolls 102. Heat and pressure applied by the fuser rollers 102 fuses both sides of the substrate simultaneously with as much energy as needed for the heavy weight substrate. Then the substrate is transferred to a cooling system 104. The cooling system 104 is provided to avoid post fuse artifacts. Here, the substrate is cooled before sending to a finishing station (not shown).

The secondary fusing device 100 may not require stripping of the substrate. No air knife is necessary because heavy weight substrates strip essentially by their own beam strength, allowing for a simpler system with fewer parts (i.e., only a pair of heated rolls). More specifically, with the secondary fusing device 100, stripper fingers and/or an air knife are not needed because heavier weight substrates have a high enough beam strength to keep the substrates from wrapping around the fuser roll 102.

Because the secondary fusing device 100 handles the heavier weight substrates, higher temperatures are not required in the primary fusing device 10. Further, the necessary nip (i.e., contact area between the rolls) and dwell times (i.e., amount of time between the rolls) may be reduced in the primary fusing device 10 allowing for a relatively smaller fuser roll 16 and a relatively smaller pressure roll 18 in comparison to the fuser rolls 102, for a more compact structure. The smaller fuser roll 16 and the smaller pressure roll 18 also allow for a faster processing time as the nip area for the smaller rolls is decreased, thereby decreasing the dwell time.

The reduced temperature in the primary fusing device 10 will also result in a longer life span of the rolls. With higher temperatures, the bonding layer between the rolls, the core of the rolls, and the oil on the rolls degrade at a higher rate, causing degrading of the fuser system in general. Thus, the lower the required temperature of the primary fusing device 10, the longer the life span of the parts therein.

More specifically, with the multi-stage fuser system of the present invention, the temperature and dwell times required in the primary fusing device 10 for heavier substrates need only be sufficient to adhere toner to the substrate just well enough so that the toner will not come off during the duplex mode, or in any other area. Thus, a reduction in temperature in the primary fusing device 10 and a potentially reduced size of the fuser roll 16 and of the pressure roll 18.

Further, with a smaller roll, it is easier to peel a sheet of paper, for example, off the roll than it is with large diameter rolls. The air knife may also be better optimized with smaller rolls to be closer to the contact arc (nip).

Still further, there is no need to convert a powder toner into a liquid toner in heavyweight papers by fully fusing, driving the toner into the paper, and then peeling the paper from the rolls in the primary fusing device 10. An image that has partially been driven into the substrate and is essentially already tacked to the paper may be fused into a liquid by the secondary fuser device 100. If the paper is transmitted to the secondary fusing device 100, it has already significantly cooled such that the image can survive without being compromised by the secondary fusing device 100.

Figure 3:
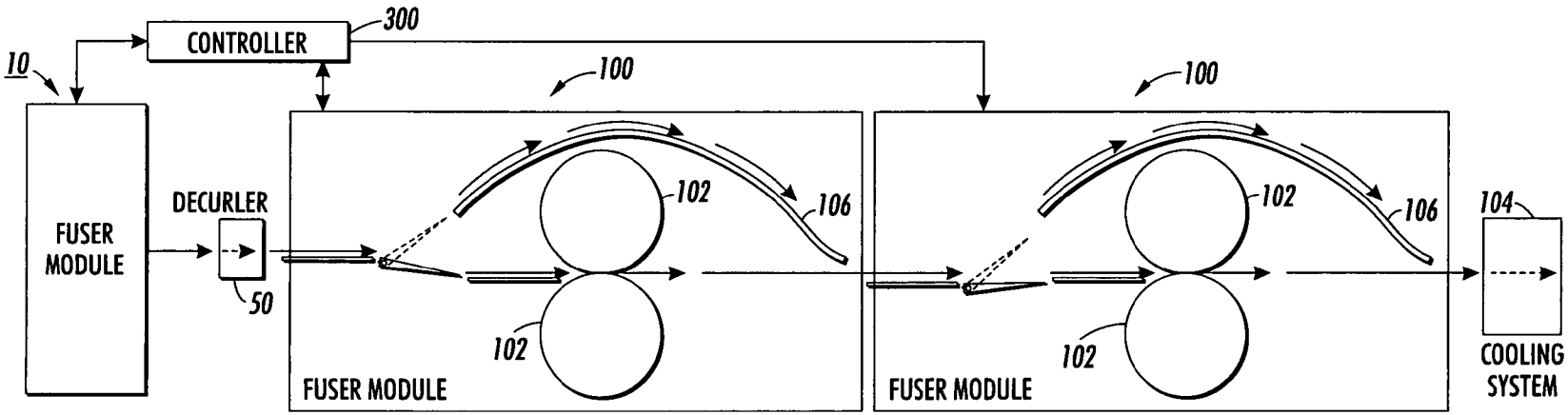
FIG. 3 illustrates a multi-stage fusing system of the present invention.
Figure 4:
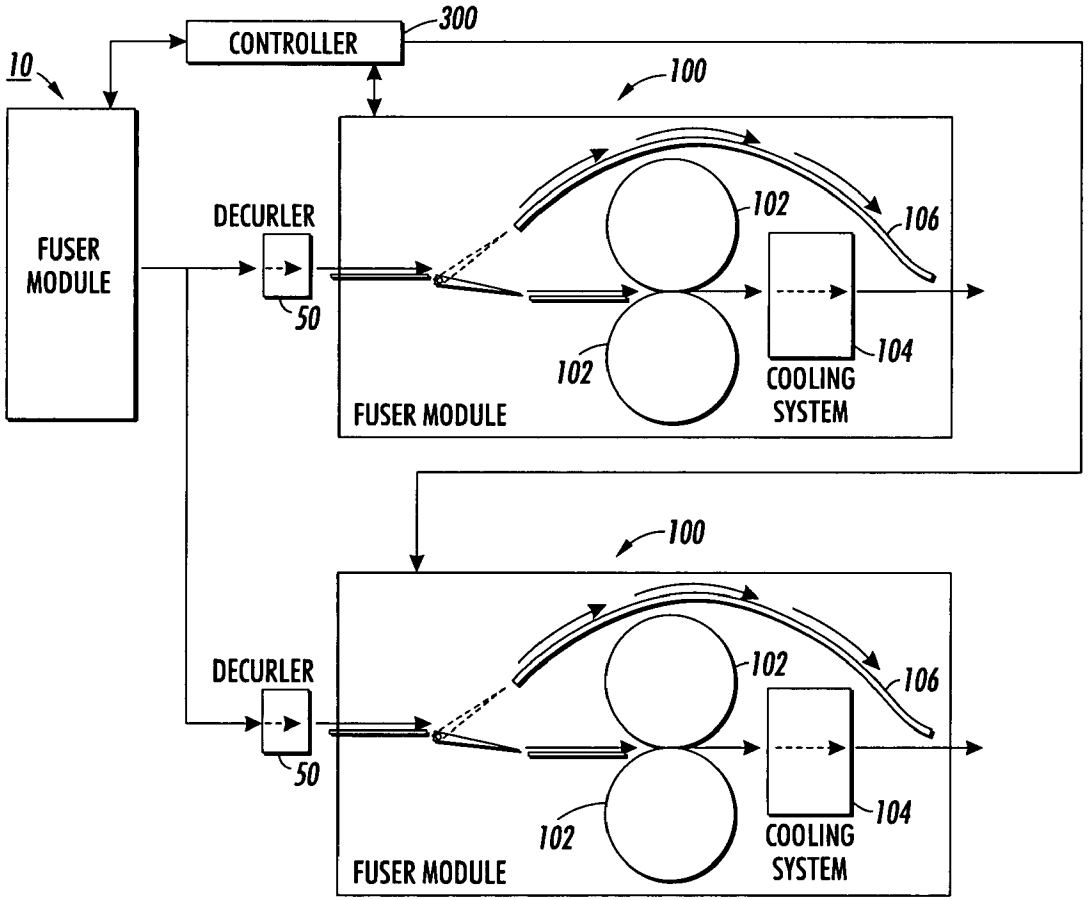
FIG. 4 illustrates a multi-stage fusing system of the present invention.

Further, it is envisioned that a variety of combinations of primary fusing devices 10 and secondary fusing devices 100 may be used. For example, with reference to FIG. 3 and FIG. 4 two secondary fusing devices 100, set at a lower speed for a longer dwell time, may be used in combination with a primary fusing device 10. A first substrate, for example, may be processed at a quicker rate in the primary fusing device (with smaller rolls) and then transported to a first of the two secondary fusing devices 100. A second substrate, for example, may be processed at a quicker rate in the primary fusing device 10. The controller 300 will recognize that the first of the secondary fusing devices 100 is busy and then transport the second substrate to a second of the two secondary fusing devices 100 while the first substrate is still being processed in the first of the secondary fusing devices 100. Thus, with this combination, the throughput of the copy machine may be nearly doubled.

It is also envisioned that modifications may be made to either the first fuser or second fuser without departing from the scope of the invention. For example, a second release agent management system may be provided with the secondary fusing device 100.

It is envisioned that the multi-stage fusing system of the present invention may be used in a variety of the different environments, such as, for example, with printers, copiers, fax machines, and the like.

Those skilled in the art will recognize that certain variations and/or additions can be made in these illustrative embodiments. It is apparent that various alternatives and modifications to the embodiments can be made thereto. It is, therefore, the intention in the appended claims to cover all such modifications and alternatives as may fall within the true scope of the invention.

What is claimed is:

1. A multi-stage fusing system for fixing toner images to copy substrates of various types, the system comprising:

a first fuser module capable of fixing a toner image to a copy substrate in a simplex or duplex mode;

a second fuser module in series with the first fuser module, the second fuser module having, a first fuser roll; and a second fuser roll in contact with the first fuser roll to form a fusing nip therebetween wherein pressure and heat from the first fuser roll and the second fuser roll are applied to both sides of the copy substrate, simultaneously; and a controller for controlling the transmission of the copy substrates in the multi-stage fusing system, wherein copy substrates of a first type are transmitted to the first fuser module for fixing toner images to the copy substrates and bypass the second fuser module, and wherein copy substrates of a second type are transmitted to the first fuser module for fixing toner images to the copy substrates and the second fuser module for further fusion of toner images on the copy substrates, and further wherein the controller recognizes when the second fuser module is busy.

2. The multi-stage fusing system of claim 1, wherein the copy substrates of the first type comprise substrates having a light weight of about 80 pounds or less, and the copy substrates of the second type comprise substrates having a heavy weight of about 100 pounds or more.

3. The multi-stage fusing system of claim 1, wherein the copy substrates of the first type and the copy substrates of the second type each comprise substrates having a weight and a beam strength wherein the weight and beam strength of the copy substrates is determined by the controller.

4. The multi-stage fusing system of claim 1, wherein the first fuser module fixes the toner image to the copy substrate of the second type such that the toner is converted from a powder to a liquid but is not completely set.

5. The multi-stage fusing system of claim 1, wherein the copy substrate of various types include light weight substrates and heavy weight substrates, wherein the multi-stage fusing system has a bypass path for allowing a light weight substrate of the copy substrates to bypass the second fuser module.

6. The multi-stage fusing system of claim 1, further comprising:

a decurler between the first fuser module and the second fuser module in series with the first fuser module.

7. The multi-stage fusing system of claim 1, further comprising:

a fuser roll and a pressure roll of the first fuser module, each having a diameter wherein the first fuser roll and the second fuser roll of the second fuser module each have a diameter larger than the diameter of the fuser roll and the pressure roll of the first fuser module.

8. The multi-stage fusing system of claim 1, wherein the first fuser roll and the second fuser roll of the second fuser module provide a longer dwell time and a larger nip area than a dwell time and nip area of each of the fuser roll and pressure roll of the first fuser module.

9. The multi-stage fusing system of claim 1, further comprising:

a set temperature of the first fuser module; and a set temperature of the second fuser module greater than the set temperature of the first fuser module.

10. The multi-stage fusing system of claim 1, further comprising:

a cooler in series with the second fuser module for cooling the copy substrates exiting from the second fuser module.

11. The multi-stage fusing system of claim 1, further comprising:

a third fuser module in series with the first fuser module, the third fuser module having, a third fuser roll; and a fourth fuser roll in contact with the third fuser roll to form a fusing nip therebetween wherein pressure and heat from the third fuser roll and the fourth fuser roll are applied to both sides of the copy substrate, simultaneously.

12. The multi-stage fusing system of claim 1, further comprising:

a third fuser module in series with the first fuser module, wherein when the controller recognizes that the second fuser module is busy, the controller transmits the copy substrate from the first fuser module to the third fuser module.

13. A method for fixing toner images to copy substrates of various weights, the method comprising:

providing a first fuser module in series with a second fuser module, wherein the second fuser module has a first fuser roll and a second fuser roll forming a nip wherein pressure and heat from each of the first fuser roll and the second fuser roll are applied to a copy substrate at the nip;

determining if the second fuser module is busy;

determining whether a substrate is of a first type requiring fusing only by the first fuser module or of a second type requiring fusing by both the first fuser module and the second fuser module;

processing the substrate with an image thereon in the first fuser module; and where the substrate is of the first type, feeding the substrate to bypass the second fuser module and where the substrate is of the second type, transmitting the substrate from the first fuser module to the second fuser module for secondary fusing.

14. The method of claim 13, wherein a temperature of the second fuser module is higher than a temperature of the first fuser module.

15. The method of claim 13, wherein a relatively longer dwell time and a relatively larger nip area are provided in the second fuser module compared to dwell time and nip area in the first fuser module.

16. The method of claim 13, further comprising:

providing a third fuser module in series with the first fuser module; and where the substrate is of the second type, transmitting the substrate from the first fuser module to the third fuser module when the second fuser module is determined to be unavailable.

17. The method of claim 13, further comprising:

cooling the substrate of the second type after exiting from the second fuser module.

18. The method of claim 13, wherein the processing of the substrate in the first fuser module comprises:

feeding the substrate to the first fuser module for processing with respect to an image of a first side of the substrate; and subsequently feeding the substrate to the first fuser module a second time for processing with respect to an image of a second side of the substrate.

19. The method of claim 13, wherein the substrate has an image on both sides, and the toner images on both sides of the substrate are simultaneously fused in the second fuser module.

20. An image forming device, comprising:

the multi-stage fusing system of claim 1.

* * * * *